US005890650A

United States Patent [19]

Penson

[11] Patent Number: 5,890,650

[45] Date of Patent: Apr. 6, 1999

[54] PACKAGING

[75] Inventor: Christopher J. Penson, Old Hatfield, United Kingdom

[73] Assignee: Xerox Corporation, Stamford, Conn.

[21] Appl. No.: 975,216

[22] Filed: Nov. 20, 1997

[30] Foreign Application Priority Data

Nov. 22, 1996 [GB] United Kingdom ..... 9624352

[51] Int. Cl.[6] ..... B65D 17/00

[52] U.S. Cl. ..... 229/243; 229/125.33; 229/123.3; 229/125.08

[58] Field of Search ..... 229/243, 108.1, 229/239, 211, 125.33, 125.22, 125.08, 123.3, 123.2

[56] References Cited

U.S. PATENT DOCUMENTS 3,162,352 12/1964 Swaim ..... 229/123.3
3,976,241 8/1976 Bemiss ..... 229/123.3
4,328,924 5/1982 Neff et al. ..... 229/123.2
5,105,950 4/1992 Gottfreid .

FOREIGN PATENT DOCUMENTS 2 288 591 10/1995 United Kingdom .

*Primary Examiner*—Gary E. Elkins
*Assistant Examiner*—Tri M. Mai
*Attorney, Agent, or Firm*—William A. Henry, II

[57] ABSTRACT

A packaging system (10) in which a lid portion (30) is secured to a base portion (20) by means of adhesive along two opposite sidewalls (24, 25). The system (10) includes a tear strip opening device (40) which provides access to the contents thereof. Structure (60, 66) is provided in each of the opposite sidewalls (24, 25) above the position of the opening device (40) which allows the lid portion (30) to be pressed onto the base portion (20) without detaching the lid portion (30) and base portion (20), the structure (66) in sidewall (25) also forms a hinge about which the lid portion (30) can be rotated once the opening device (40) has been operated.

3 Claims, 8 Drawing Sheets

PACKAGING

BACKGROUND OF THE INVENTION

1. Field of the Invention

The present invention relates to improvements in or relating to packaging, and is more particularly concerned with the packaging of paper in boxes.

2. Description of the Prior Art

It is well known that paper for photocopying apparatus, and for other uses, is supplied in boxed form, typically each box of A4 or A3 paper containing five reams of paper (a ream is 500 sheets) depending on the weight of the paper, for example, 80 $gm^{-2}$ or 100 $gm^{-2}$, each ream being packaged separately. Each box comprises a base portion and a lid portion which is secured to the base portion by means of a plastic band which passes around the box. In most cases, it is preferred that the stack of paper within the box takes the weight of additional boxes stacked on top thereof so that the box maintains its integrity.

Each box is formed by placing a stack of five packaged reams of paper on a blank from which the base portion of the box is to be made, the stack being positioned on the portion of the blank which will form the base of the box. The other portions of the blank are folded up around the stack and glued in position to form the base portion. The lid portion of the box is formed in a similar way, that is, the blank corresponding to the lid portion is placed on top of the stack (which is now inside the base portion) and folded and glued accordingly. The lid portion of the box is secured to the base portion by the plastic band.

Such a band is often used as a means of carrying the box of paper and this damages the box as well as the uppermost and lowermost reams of paper inside the box. Furthermore, the band is often difficult to remove and needs to be safely disposed of. Moreover, as the paper size increases, it becomes more difficult to carry the box of paper, and if the plastic band is used, it can cut into a person's fingers due to the increased weight.

The following disclosures may be relevant to various aspects of the present invention:

GB-A-2 288 591 discloses a box for products in sheet form which comprises a base portion and a lid portion which is adhered to the base portion along two opposed sidewalls using adhesive The lid portion is provided with a tear-off perforation strip on one of the opposed sidewalls above the adhesive so that, when access to the box is required, the strip is readily detached from the lid portion to allow access to the interior of the box.

In U.S. Pat. No. 5,105,950, a cardboard carton is provided which has a body with opposite side and end walls, closed bottom, and an open top defined by a top edge. A lid is fastened to a carton body by glue or other means fastening the bottom fastening sections of the lid to the carton body side wall. Typically, the carton is filled with material to be packaged extending from the carton bottom in a stack up past the top edge of the carton body.

It is therefore an object of the present invention to provide an improved packaging system for paper which overcomes the problems discussed above.

SUMMARY OF THE INVENTION

In accordance with one aspect of the present invention, there is provided a packaging system for packaging paper, the system comprising:

a base portion including a base and sidewalls connected thereto to define a container, the base portion including at least two opposed continuous sidewalls; and a lid portion including a top and sidewalls connected thereto, the lid portion being sized so that its sidewalls overlap the sidewalls of the base portion when positioned thereon and is secured to the base portion by adhesive along two opposed continuous sidewalls;

characterized in that the base portion includes a tear strip opening device located in one of its continuous sidewalls which allows access to the packaging system for removal of its contents, and in that the two opposed continuous sidewalls have creases formed therein below the tear strip opening device, the creases allowing the lid portion to be pressed onto the base portion without breaking the adhesive, the lid portion being secured to the base portion such that the ends of the sidewalls thereof are spaced from the top of the lid portion and that the ends of the sidewalls not adhered to the lid portion are free to move towards the top of the lid portion as the lid portion is pressed onto the base portion.

In addition, at least one of the creases on the sidewall opposite that including the tear strip opening device forms a hinge about which the lid portion can be rotated to allow access to the contents.

It is preferred that the base portion and lid portion are formed with additional creases which enable the opened system to be folded flat for disposal.

The system of the present invention has the advantage that existing blanks can be used and the new features can be provided by additional fold lines and cut outs. In particular, a tear strip can be added to the raw material from which the blank for the base portion is made, in a suitable position relative to an edge thereof. Moreover, existing packaging equipment can be used for implementing the system.

Advantageously, the system in accordance with the present invention provides a 'concertina' feature which takes up any ullage present in the packaging or which is generated due to compression of the contents. This is most important where the contents of the system provide the stacking strength but at the same time the packaging integrity has to be maintained.

BRIEF DESCRIPTION OF THE DRAWINGS

For a better understanding of the present invention, reference will now be made, by way of example only, to the accompanying drawings, in which.

DETAILED DESCRIPTION OF THE DRAWINGS

The present invention will be described with reference to packaging boxes for A4 paper, but it will be readily appreciated that the invention is equally applicable to the packaging of other sizes of paper, and to the packaging of other materials.

Figure 1:
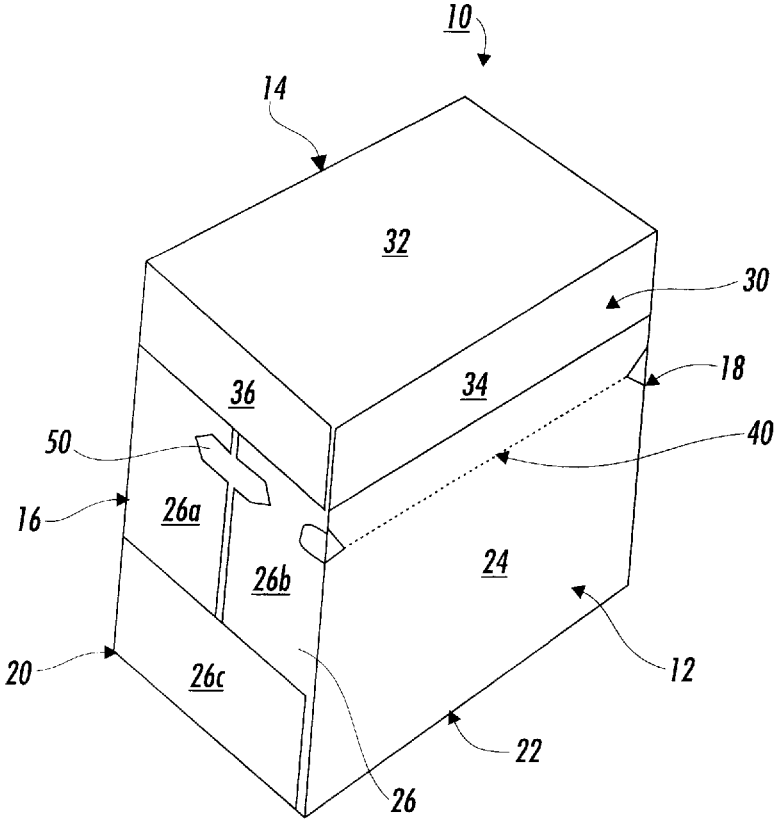
FIG. 1 is a perspective view of a paper packaging box, in its closed state, in accordance with the present invention.

In FIG. 1, a packaging box 10 in accordance with the present invention is shown. The box 10 is a cuboid and has rectangular sidewall faces 12, 14, 16, 18 as shown, a pair of opposite sidewall faces 12, 14 being longer than adjacent sidewall faces 16, 18—only sidewall faces 12 and 16 being visible in FIG. 1. The box 10 comprises a base portion 20 and a lid portion 30.

Figure 7:
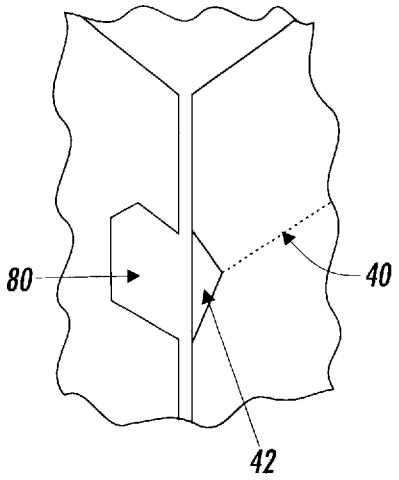
FIG. 7 is a detailed view of a corner of the box where one end of a tear strip opening device in accordance with the present invention is located.

The base portion 20 comprises a base 22 (shown in FIG. 2) and sidewall faces 24, 25, 26, 27 (faces 24, 26 only being shown in FIG. 1). Sidewall face 24 includes a tear strip opening device 40 (FIG. 7) which is positioned below the top thereof and below where the lid portion 30 covers that sidewall face. The tear strip opening device 40 will be described with reference to FIG. 7 below. Sidewall faces 26, 27 each include a handle portion 50, 52 (only handle portion 50 is schematically shown in FIG. 1) located below the lid portion 30. The construction of handle portions 50, 52 is described in more detail with reference to FIG. 10 below.

The lid portion 30 comprises a top 32 and sidewall faces 34, 35, 36, 37 (only faces 34, 36 being visible in FIG. 1). The lid portion 30 is secured to base portion 20 using adhesive (as shown by 'X' in FIG. 5) which is applied along the inside of sidewall faces 34, 35 which contact respective sidewall faces 24, 25 of the base portion 20.

Figure 3:
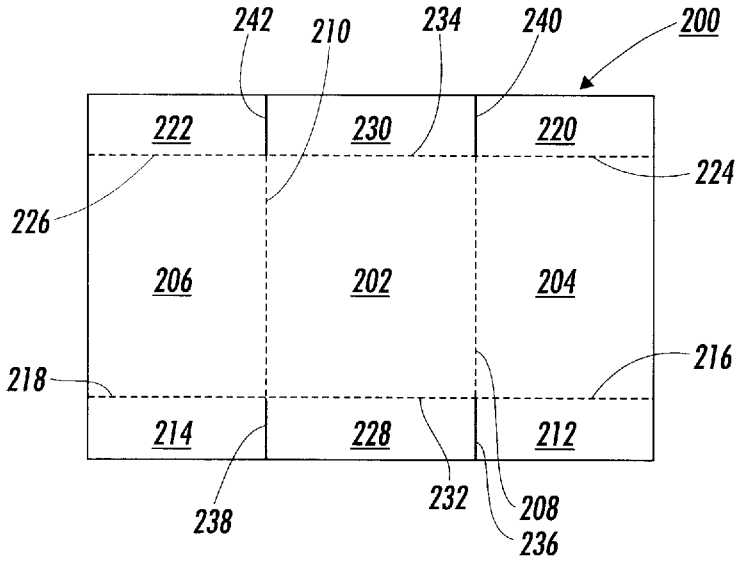
FIG. 3 is a plan view of a blank which is used to make the base of the box shown in FIG. 1.
Figure 4:
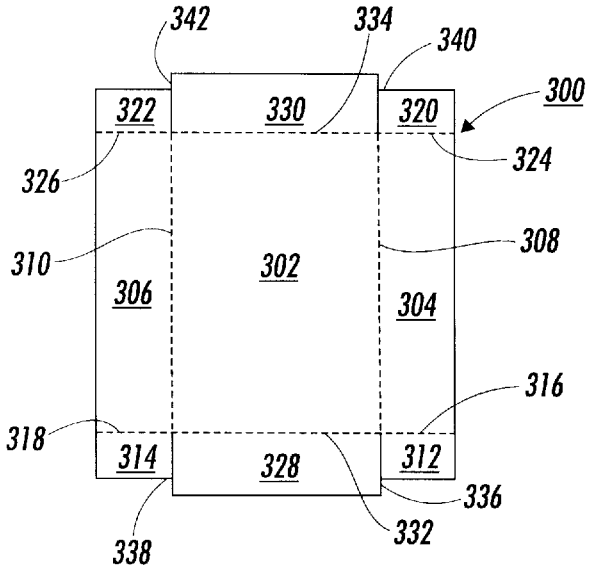
FIG. 4 is a plan view of a blank which is used to make the top of the box shown in FIG. 1.

Respective blanks 200, 300 from which the base portion 20 and the lid portion 30 are formed are shown in FIGS. 3 and 4 and will be described in detail later.

Figure 2:
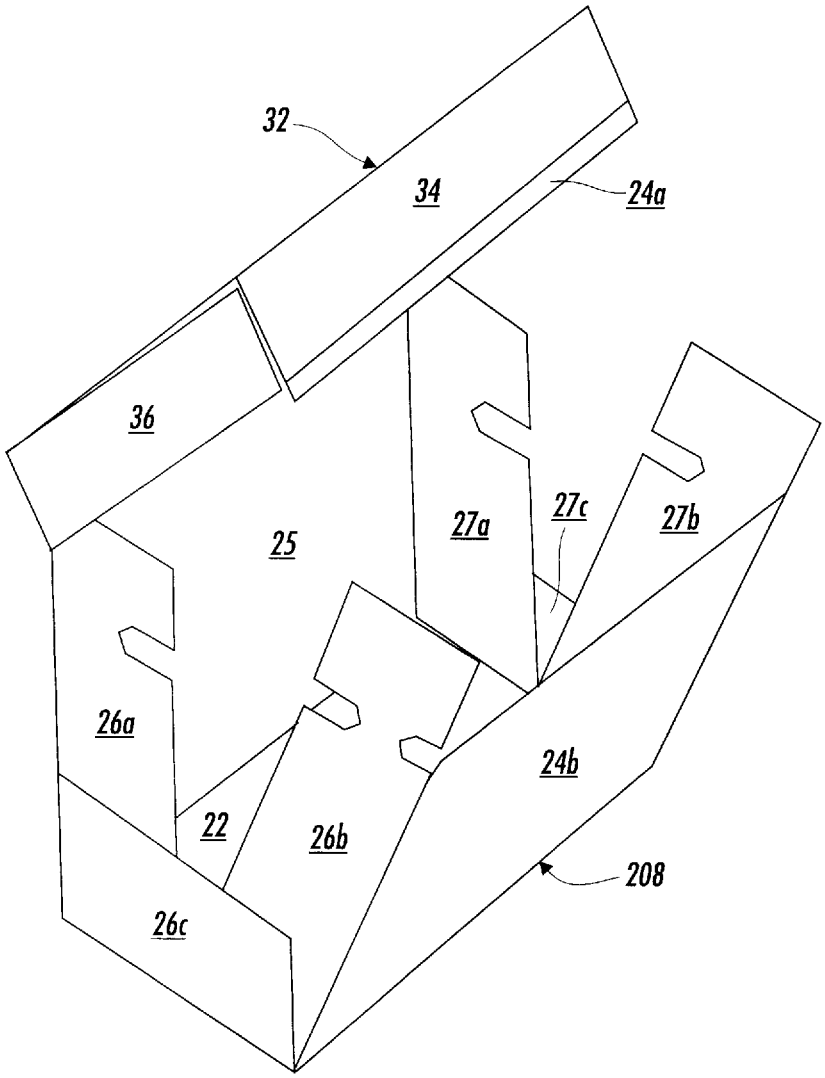
FIG. 2 is a perspective view of the box shown in FIG. 1 when opened.

When the tear strip opening device 40 (FIG. 7) is operated, that is, the box 10 is opened, the lid portion 30 together with upper portion 24*a* of sidewall face 24 of the base portion 30 can be lifted up so that the contents of the base portion 20 can be accessed. This is illustrated in FIG. 2. Moreover, due to the construction of the base portion 20 of the box 10, lower portion 24*b* of sidewall face 24, together with portions 26*b*, 27*b*, can easily be folded out by breaking the adhesive between portions 26*b*, 27*b* and respective portions 26*c*, 27*c* (the location of adhesive being shown by 'X' in FIGS. 5 and 6) and to provide easy access to the contents of the box 10, portions 26*a*, 26*c* and portions 27*a*, 27*c* remaining attached to one another. The location of adhesive spots holding portions 26*a*, 26*b*, 26*c* together are shown by 'X' in FIG. 5. It will be appreciated that portions 27*a*, 27*b*, 27*c* are held together in the same manner.

Figure 5:
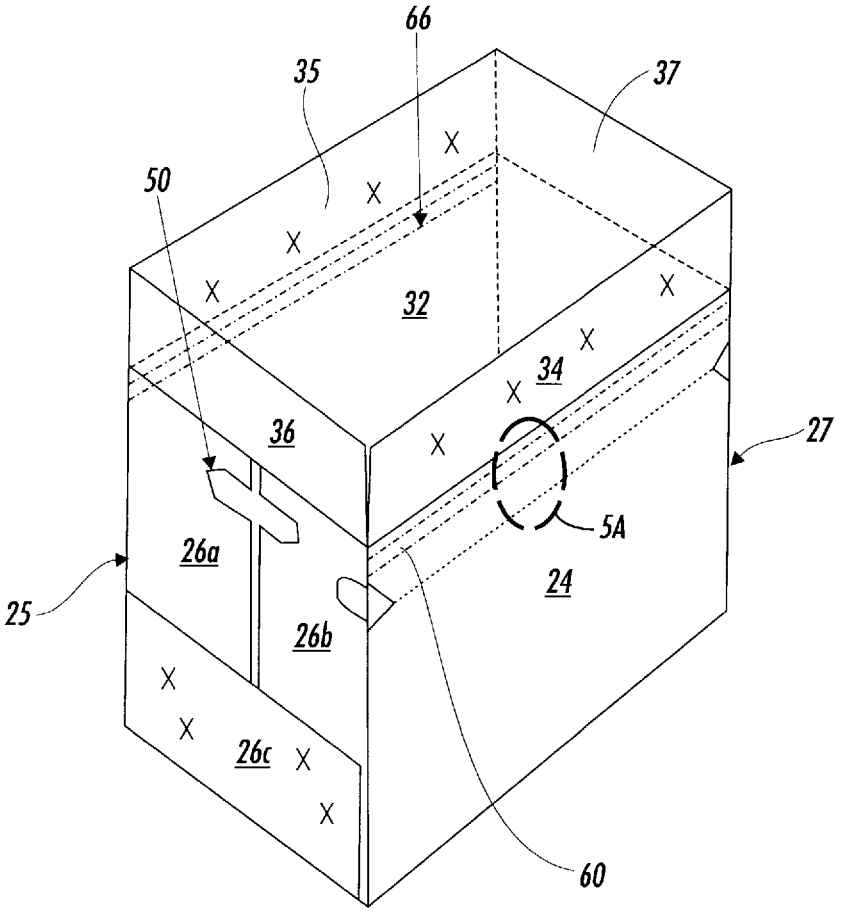
FIG. 5 is another perspective view of the box shown in FIG. 1 which illustrates further constructional features thereof.
Figure 5A:
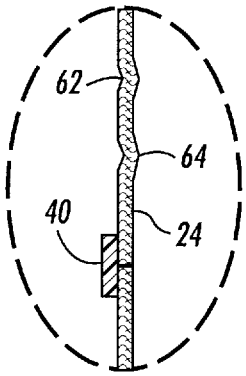

Referring now to FIG. 3 in detail the basic blank 200 from which the base portion 20 is formed is shown. The location of the tear strip opening device 40 and handle portions 50, 52 have been omitted for clarity. The blank 200 comprises a rectangular central portion 202 which forms the base 22 of the box 10, and on which the five-ream stack of paper is positioned prior to the base portion being folded up, as described above. Portions 204, 206, when folded along respective fold lines 208, 210 to be substantially perpendicular to the central portion 202, form respective sidewalls 24, 25. Sidewall face 26 is formed by portion 212 of portion 204 (portion 26*b* in FIGS. 1 and 2) and portion 214 of portion 206 (portion 26*a* in FIGS. 1 and 2) and when folded along respective fold lines 216, 218. Similarly, sidewall face 27 is formed by portion 220 of portion 204 (portion 27*b* in FIG. 2) and portion 222 of portion 206 (portion 27*a* in FIG. 2) when folded along lines 224, 226 respectively. Sidewall faces 26, 27 are held in place by portions 228, 230, which are integrally formed with central portion 202, and which are folded along respective lines 232, 234 to form portions 26*c*, 27*c* as shown in FIG. 2. Adhesive, as shown in FIG. 5 (and described above), is used to secure portions 228, 230 against respective portions 214, 222. It will be readily appreciated that slits 236, 238, 240, 242 are provided so that the fold lines 216, 218, 224, 226 can be folded as desired.

For paper packaging, it is preferred that the contents of the box, that is, the paper, take the weight of boxes stacked on it. This means that the base portion 20 is made such that the uppermost ream of the stack stands proud of the top thereof, that is, the overall height of the base portion 20 is chosen to be less than the height of five reams of paper. The lid portion 30 then rests on the uppermost ream of the paper and not the upper edges of the sidewall faces 24, 25, 26, 27 of base portion 20.

FIG. 4 illustrates the basic blank 300 from which the lid portion 30 is formed, and comprises a central rectangular portion 302 which forms the top 32 and portions 304, 306, 328, 330 which form sidewall faces 34, 35, 36, 37 when folded along respective fold lines 308, 310, 332, 334. Portions 312, 320 attached to portion 304 and portions 314, 322 attached to portion 306 are folded along respective fold lines 316, 324, 318, 326 so that they lie under portions 328, 330 (sidewall faces 36, 37) and are secured thereto by adhesive (not shown). In a similar way to blank 200 shown in FIG. 3, blank 300 has slits 336, 338, 340, 342 to enable portions 312, 314, 320, 322 to be folded as desired.

Referring now to FIGS. 5, 6, 7 and 8 which illustrate more features of the box 10, base portion 12 includes a pair 60 of crease lines 62, 64 positioned on sidewall face 24 and located below sidewall face 34 of lid portion 30 and above tear strip opening device 40. Similarly, on sidewall face 25, a pair 66 of crease lines 68, 70 are positioned to be at the same relative location from the base 22 of the box 10 as crease lines 62, 64 on sidewall face 24. However, it will be appreciated that the crease lines on sidewall face 25 need not be at the same relative location, but may be located at any suitable position. Upper comers 72, 74, 76, 78 of the base portion 20 are slit so that the lid portion 30 can be separated from the base portion 20 when the tear strip opening device 40 has been operated and lifted upwards to allow access to the contents in the box 10. Upper comers 72, 74 are slit down to the tear strip opening device 40 on sidewall face 24, and upper comers 76, 78 are slit down to just below (approximately 25 mm) the creases 68, 70 on sidewall face 25. Lower crease line 70 in sidewall face 25 acts as a hinge to allow the lid portion 30 to be folded backwards (as shown in FIG. 2). A cut-out portion 80 is provided in sidewall face portion 26*b* (FIG. 7) to allow access to one end 42 of the tear strip opening device 40. It will be appreciated that another cut-out portion (not shown) can also be provided in sidewall face portion 27*b* if the tear strip opening device 40 can be operated from either end.

Figure 6:
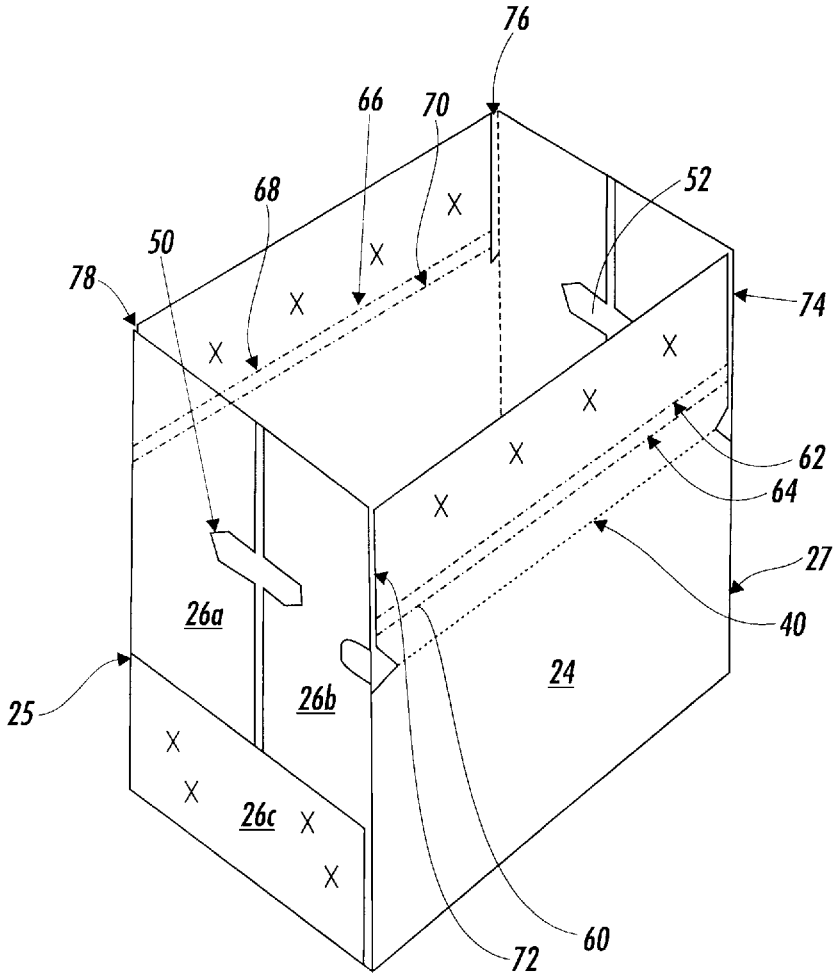
FIG. 6 is similar to FIG. 5, but with the lid removed.
Figure 8:
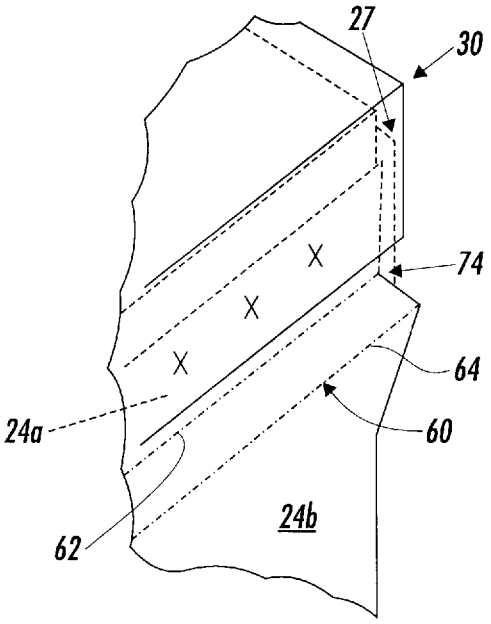
FIG. 8 illustrates the 'concertina' feature in accordance with the present invention.

In accordance with the present invention, the crease lines 62, 64, 68, 70 form a 'concertina' feature which, as the base portion 20 is joined to the lid portion 30 only along pairs of sidewall faces 24, 34 and 25, 35 (as indicated by the location of 'X' corresponding to adhesive spots in FIGS. 5, 6 and 8), provides a means of allowing the sidewall faces 24, 25 to swell outwards when pressure is applied to the lid portion 30 of the box 10 making the contents thereof settle, that is, when pressure is applied to the paper through the lid portion 30 of the box 10. If the 'concertina' feature is not provided, the lid portion 30 could become detached from the base portion 20 when pressure is applied, damaging the box and/or its contents. It will be appreciated that, for the 'concertina' feature to operate, the lid portion 30 is not positioned on the base portion 20 such that sidewall faces 24, 25, 26, 27 abut top 32 of the lid portion 30 but rests on the uppermost ream of the stack of paper which stands proud of the base portion 20 as discussed above. As the top 32 of the lid portion rests on the uppermost ream, a predetermined spacing is provided between the sidewall faces 24, 25, 26, 27 and the top 32 of the lid portion 30 when the lid portion 30 is attached to the base portion 20. When the lid portion 30 is pressed onto the base portion 20, as there is a spacing between the sidewall faces and the top 32 of the lid portion 30, the unattached sidewall faces 26, 27 can move upwards into the lid portion 30 as the 'concertina' feature operates.

The tear strip opening device 40 comprises a plastic strip which is attached to the inside of the base portion 20 along sidewall face 24. When end 42 (FIG. 7) is accessed through cut-out portion 80 and pulled, the sidewall face portion 24 tears along the strip as it is attached to the sidewall face 24 along its entire length.

Figure 9:
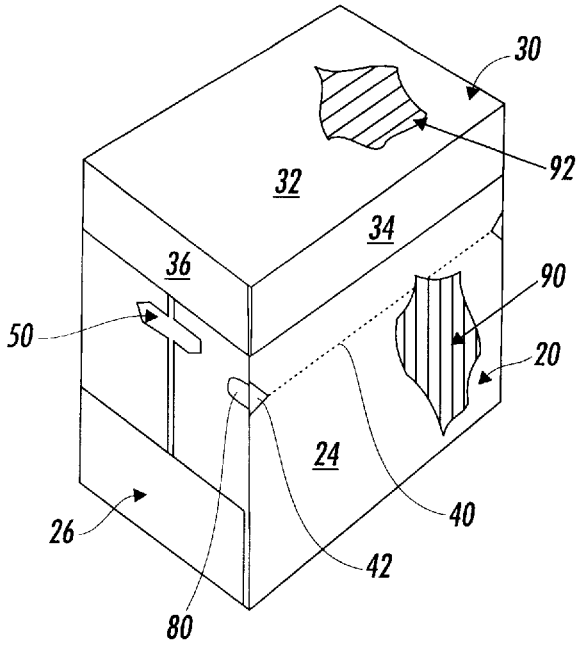
FIG. 9 illustrates the orientation of material which can be used to construct the box in accordance with the present invention.

It is preferred that the box 10 is made of corrugated cardboard, and that the direction of fluting of the corrugations is as illustrated in FIG. 9, that is, the fluting extends substantially vertically in the sidewall faces 24, 25, 26, 27 of the base portion 20 (with the exception of portions 26*c*, 27*c*—FIG. 2) and substantially horizontally in the top 32 of the lid portion 30 as shown by respective areas 90, 92.

Figure 10:
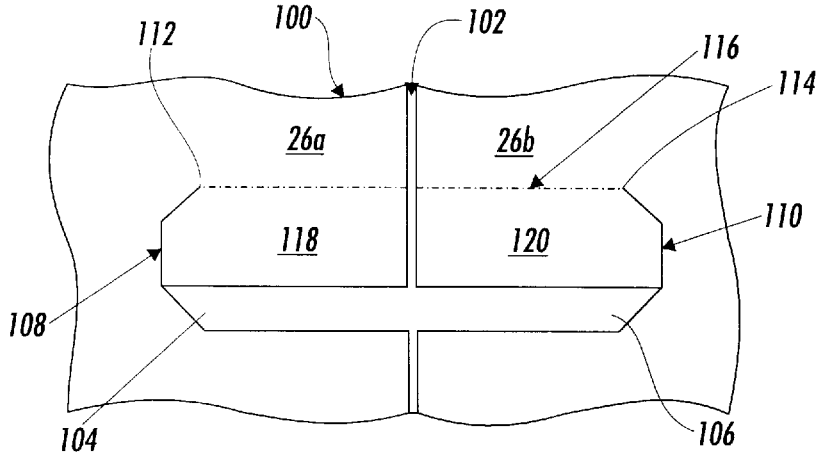
FIG. 10 shows a detailed view of a handle portion of the box.

FIG. 10 illustrates how handle portions 50, 52 are formed in respective ones of sidewall faces 26, 27. Only the formation of handle portion 50 will be described, but it will be appreciated that, as each handle portion 50, 52 is identical, handle portion 52 is formed in the same way. In FIG. 10, a portion 100 of sidewall face 26 is shown. It will be appreciated that due to the construction of the box 10, sidewall face 26 comprises two portions 26*a*, 26*b* (as described above) which meet at an interface 102. Slots 104, 106 are cut out of portions 212, 214, 220, 222 of blank 200 (not shown in FIG. 2) for each handle portion 50, 52. Shaped slits 108, 110 are formed from respective ones of the slots 104, 106 and extend generally upwards to respective points 112, 114 which lie on a crease line 116 which extends across the interface 102 as shown when sidewall face portions 26*a*, 26*b* are brought together. Each handle portion 50, 52 is formed by pulling portions 118, 120 of respective sidewall face portions 26*a*, 26*b* out of the box 10 and folding them back against the outside of sidewall face portions 26*a*, 26*b*. Preferably, the portions 118, 120 cover edges of lid portion 30 so that a user's fingers are not cut or scraped by the lid portion 30.

Figure 11:
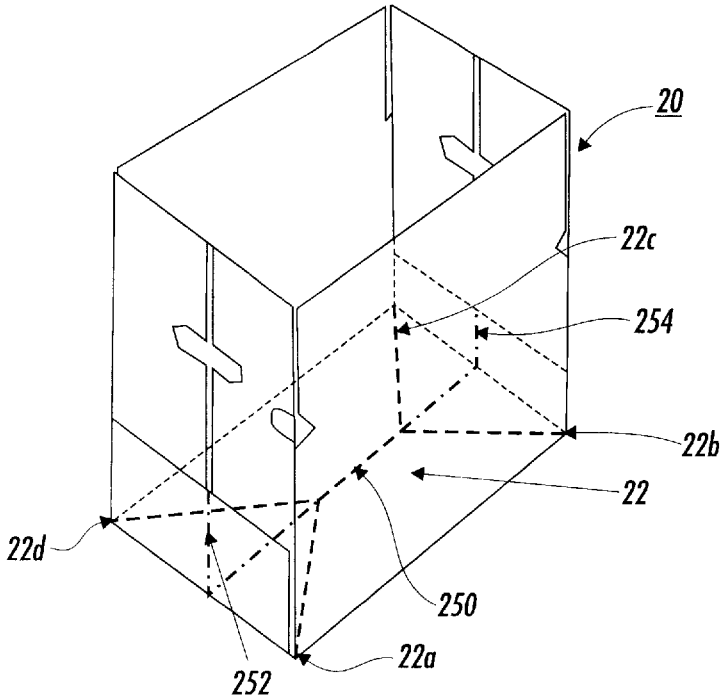
FIGS. 11 and 12 illustrate further benefits of the present invention.
Figure 12:
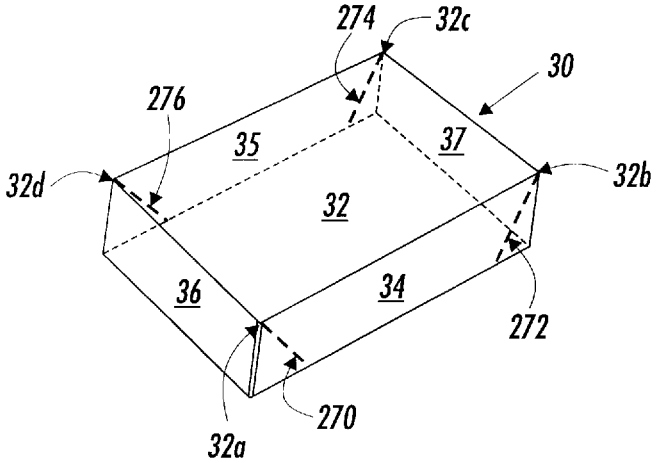

FIGS. 11 and 12 illustrate the positions of further creases which are provided respectively in the base portion 20 and lid portion 30. These further creases are provided to enable the box 10 to be folded flat for disposal after use. In base portion 20, fold lines 250, 252, 254 are provided across the base 22 and up respective sidewall face portions 26*c*, 27*c* as shown. Angled fold lines 256, 258, 260, 262 extend from respective corners 22*a*, 22*b*, 22*c*, 22*d* of base 22 and connect with fold line 250 to enable the base portion 20 to be folded flat. Similarly, in lid portion 20, fold lines 270, 272, 274, 276 extend from corners 32*a*, 32*b*, 32*c*, 32*d* along sidewall faces 34, 35 as shown.

It will be readily appreciated that the box 10 of the present invention can be re-used once it has been opened. Fastening means (not shown) may be provided to secure the lid portion 30 and upper portion 24*a* of sidewall face 24 to lower portion 24*b* thereof once the sealed box 10 has been opened.

It will be seen that according to the present invention an advantageous method and apparatus is provided for packaging paper. While the invention has been herein shown and described in what is presently conceived to be the most practical and preferred embodiment thereof, it will be apparent to those skilled in the art that many modifications can be made thereof within the spirit and scope of the invention, which scope is to be accorded the broadest interpretation of the appended claims so as to encompass all equivalent structures and methods.

I claim:

1. A packaging system for packaging paper, the system comprising:

a base portion including a base and sidewalls connected thereto to define a container, said base portion including at least two opposed continuous sidewalls; and a lid portion including a top and sidewalls connected thereto, said lid portion being sized so that its sidewalls overlap said sidewalls of said base portion when positioned thereon and is secured to said base portion by adhesive along two opposed continuous sidewalls;

and wherein said base portion includes a tear strip opening device located in one of its continuous sidewalls which allows access to the packaging system for removal of its contents, and wherein said two opposed continuous sidewalls shave creases formed therein below said tear strip opening device, said creases allowing said lid portion to be pressed onto said base portion without breaking the adhesive, said lid portion being secured to said base portion such that said ends of said sidewalls thereof are spaced from said top of said lid portion, and wherein said ends of said sidewalls not adhered to said lid portion are free to move towards said top of said lid portion as said lid portion is pressed onto said base portion.

2. A system according to claim 1, wherein at least one of said creases on said sidewall opposite that including said tear strip opening device forms a hinge about which said lid portion can be rotated to allow access to the contents.

3. A system according to claim 1, wherein said base portion and lid portion are formed with additional creases which enable the opened system to be folded flat for disposal.

* * * * *